US010962208B1

(12) United States Patent
Hsu

(10) Patent No.: US 10,962,208 B1
(45) Date of Patent: Mar. 30, 2021

(54) LAMP HAVING SLIDEABLY EXTENDABLE ILLUMINATION UNITS

(71) Applicant: Dong Guan Jia Sheng Lighting Technology Co., Ltd. China, Dong-Guna (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/729,608

(22) Filed: Dec. 30, 2019

(51) Int. Cl.

| | |
|---|---|
| ***F21V 21/34*** | (2006.01) |
| ***F21V 21/22*** | (2006.01) |
| ***F21S 8/00*** | (2006.01) |
| *F21Y 103/30* | (2016.01) |
| *F21Y 103/20* | (2016.01) |

(52) U.S. Cl.
CPC ..... *F21V 21/22* (2013.01); *F21S 8/031* (2013.01); *F21S 8/038* (2013.01); *F21Y 2103/20* (2016.08); *F21Y 2103/30* (2016.08)

(58) Field of Classification Search
CPC ..... F21V 21/22; F21V 21/34; F21V 21/14; F21V 21/005; F21V 21/35; F21S 8/046; F21S 8/043; F21K 9/235
See application file for complete search history.

(56) References Cited

U.S. PATENT DOCUMENTS

| | | | | |
|---|---|---|---|---|
| 1,611,903 | A * | 12/1926 | Gelb | F16M 11/24 248/590 |
| 3,496,518 | A * | 2/1970 | Donato | H01R 25/14 439/118 |
| 6,325,525 | B1 * | 12/2001 | Camarota | F21V 21/35 362/249.11 |
| 6,431,726 | B1 * | 8/2002 | Barton | F21V 17/007 362/217.05 |
| 9,039,230 | B2 * | 5/2015 | Crimi | H01R 25/142 362/219 |
| 9,765,954 | B2 * | 9/2017 | Zaderej | F21V 23/00 |
| 10,018,311 | B2 * | 7/2018 | Bobbo | F21S 2/005 |
| 10,527,272 | B2 * | 1/2020 | Layne | F21V 23/06 |
| 10,663,118 | B1 * | 5/2020 | Hsu | F21S 8/043 |
| 10,670,247 | B2 * | 6/2020 | Ansems | F21V 14/02 |
| 2013/0141914 | A1 * | 6/2013 | Lai | F21V 21/22 362/249.03 |
| 2018/0135849 | A1 * | 5/2018 | Paseta | A47K 3/38 |
| 2019/0335675 | A1 * | 11/2019 | Ngo | F21V 21/22 |

* cited by examiner

*Primary Examiner* — Ismael Negron
(74) *Attorney, Agent, or Firm* — Alan D. Kamrath; Karin L. Williams; Mayer & Williams PC

(57) ABSTRACT

A lamp includes a base defining a chamber and having a wall plate covering the chamber, a power supply mounted in the chamber, two T-shaped tracks projecting from a bottom surface of the base, and two illuminating units each including a light emitting module and a slideway coupled to a corresponding one of the tracks such that the illuminating units can slide along the track.

5 Claims, 6 Drawing Sheets

LAMP HAVING SLIDEABLY EXTENDABLE ILLUMINATION UNITS

BACKGROUND OF THE INVENTION

1. Field of the Invention

The present invention relates to an illuminating apparatus and, more particularly, to an extendable lamp.

2. Description of the Related Art

A conventional lamp comprises a light emitting module to emit light outward so as to provide an illuminating function. The conventional lamp has adjustable height and lighting angle to satisfy the user's requirement. However, the length of the conventional lamp cannot be extended or adjusted, such that the lighting range of the light emitting module is limited and cannot be regulated according to the practical requirement of the environment or situation of the working place, thereby limiting the versatility of the conventional lamp.

BRIEF SUMMARY OF THE INVENTION

The primary objective of the present invention is to provide an extendable lamp having an adjustable length.

In accordance with the present invention, there is provided an extendable lamp comprising a base, a power supply mounted in the base, and two illuminating units movably mounted on a bottom of the base respectively. The base includes a mounting seat and a wall plate covering the mounting seat. The mounting seat of the base has an interior provided with a receiving chamber. The mounting seat of the base has a bottom provided with two tracks. Each of the two tracks of the mounting seat has an inverted T-shaped profile and includes a guide rail connecting and protruding from the bottom of the mounting seat, and a limit block mounted on a bottom of the guide rail. The power supply is electrically connected with the two illuminating units, and is received in the receiving chamber. Each of the two illuminating units includes a housing, two end caps mounted on two ends of the housing, and a light emitting module mounted in the housing. The housing of each of the two illuminating units has an interior provided with a receiving slot. The housing of each of the two illuminating units has a top provided with a slideway slidably mounted on one of the two tracks of the mounting seat. The slideway of each of the two illuminating units is slidable on the limit block of one of the two tracks and has a top provided with a guide channel slidable on the guide rail of one of the two tracks. The light emitting module is mounted in the receiving slot of the housing.

According to the primary advantage of the present invention, the two illuminating units are moved outward from the base, such that the length of the extendable lamp is adjusted according to the user's requirement.

According to another advantage of the present invention, the two illuminating units are moved to change the light emitting range, such that the user can regulate the lighting effect according to the requirement of the environment or situation.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
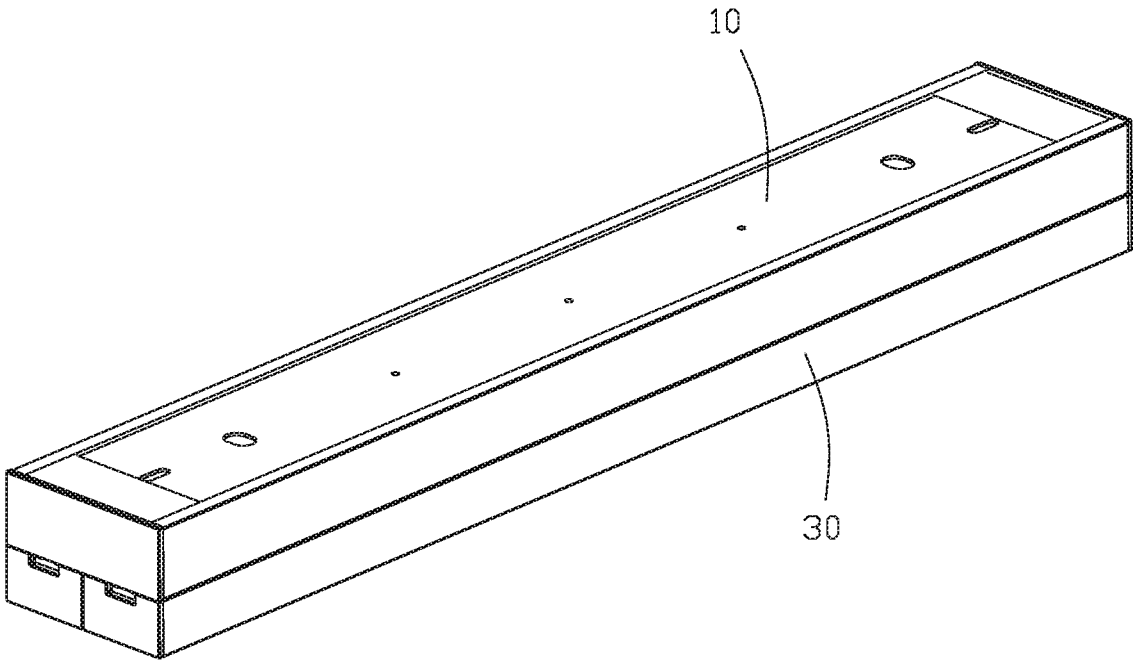
FIG. 1 is a perspective view of an extendable lamp in accordance with the preferred embodiment of the present invention.

Referring to the drawings and initially to FIGS. 1-5, an extendable lamp in accordance with the preferred embodiment of the present invention comprises a base 10, a power supply 20 mounted in the base 10, and two illuminating units 30 movably mounted on a bottom of the base 10 respectively.

The base 10 includes a mounting seat 12 and a wall plate 11 covering the mounting seat 12. The wall plate 11 of the base 10 is attached to a wall or a ceiling. The mounting seat 12 of the base 10 has an interior provided with a receiving chamber 121. The mounting seat 12 of the base 10 has a bottom provided with two tracks 122. Each of the two tracks 122 of the mounting seat 12 has an inverted T-shaped profile and includes a guide rail connecting and protruding from the bottom of the mounting seat 12, and a limit block 123 mounted on a bottom of the guide rail. The limit block 123 of each of the two tracks 122 has a width greater than that of the guide rail.

The power supply 20 is electrically connected with the two illuminating units 30, and is received in the receiving chamber 121. The power supply 20 provides an electric energy to the two illuminating units 30.

The two illuminating units 30 slides on the bottom of the base 10. Each of the two illuminating units 30 includes a housing 31, two end caps 32 mounted on two ends of the housing 31, and a light emitting module mounted in the housing 31. The housing 31 of each of the two illuminating units 30 has an interior provided with a receiving slot 313 which extends through the housing 31 transversely. The housing 31 of each of the two illuminating units 30 has a top provided with a slideway 312 slidably mounted on one of the two tracks 122 of the mounting seat 12. The slideway 312 of each of the two illuminating units 30 is slidable on the limit block 123 of one of the two tracks 122 and has a top provided with a guide channel 311 slidable on the guide rail of one of the two tracks 122. The guide channel 311 of each of the two illuminating units 30 has a width smaller than that of the slideway 312. The light emitting module is mounted in the receiving slot 313 of the housing 31.

In the preferred embodiment of the present invention, each of the two end caps 32 includes a cap body 321 and an insert 322 mounted on the cap body 321. Each of the two end caps 32 has a top provided with a mounting groove 323. The mounting groove 323 of each of the two end caps 32 extends through the cap body 321 and the insert 322.

In the preferred embodiment of the present invention, the receiving slot 313 of the housing 31 has a top provided with a projection 314 extending downward. The mounting groove 323 of each of the two end caps 32 is locked on the projection 314 of the housing 31. The insert 322 of each of the two end caps 32 is inserted into the receiving slot 313 of the housing 31.

In the preferred embodiment of the present invention, each of the two illuminating units 30 is a cuboid.

Figure 6:
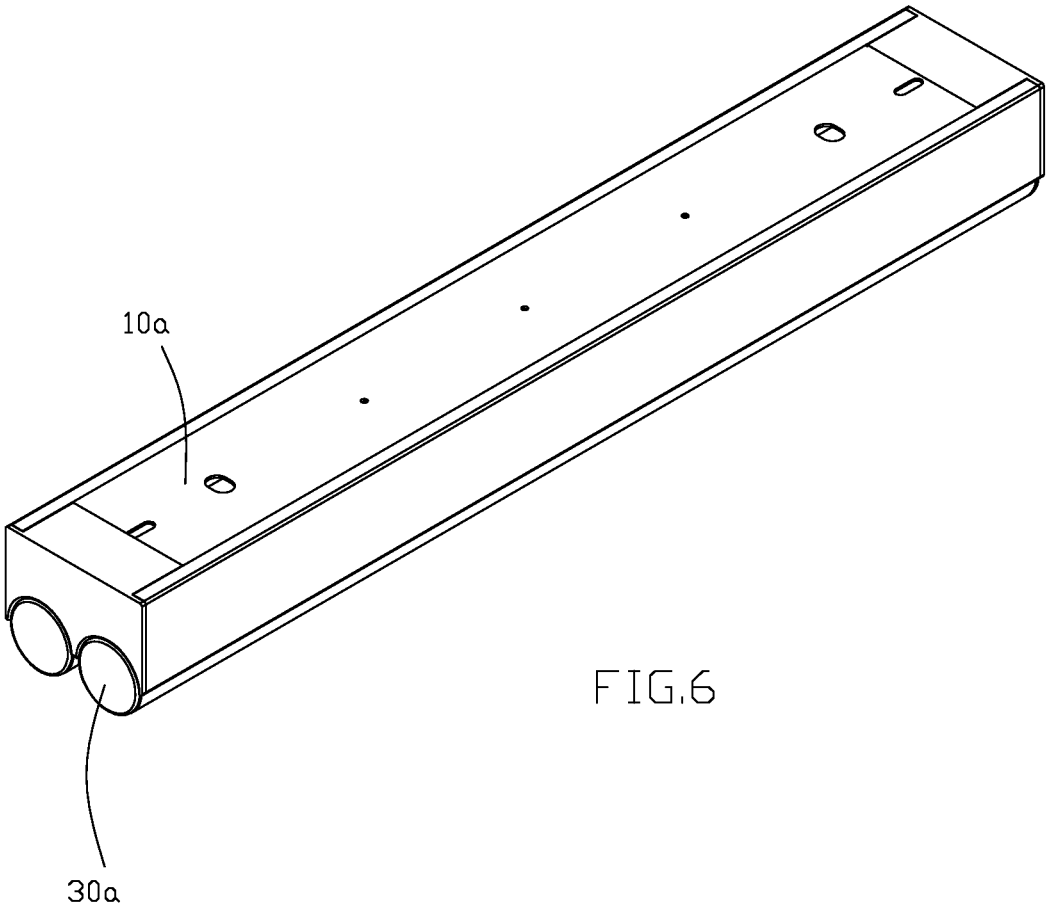
FIG. 6 is a perspective view of an extendable lamp in accordance with another preferred embodiment of the present invention.

Referring to FIG. 6, each of the two illuminating units 30*a* is mounted on the bottom of the base 10*a* and has a cylindrical shape.

Figure 2:
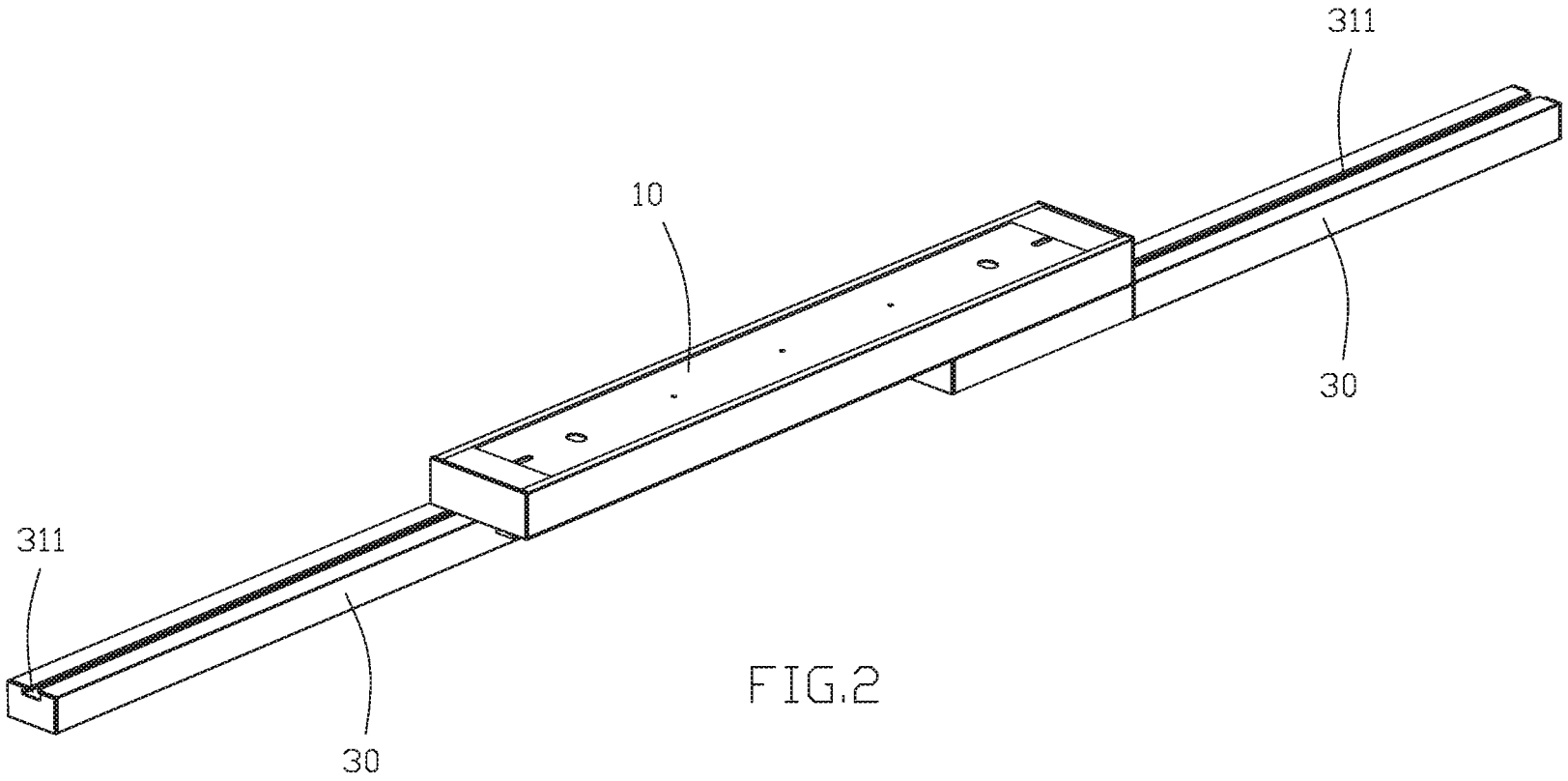
FIG. 2 is a schematic operational view of the extendable lamp as shown in FIG. 1 in use.
Figure 3:
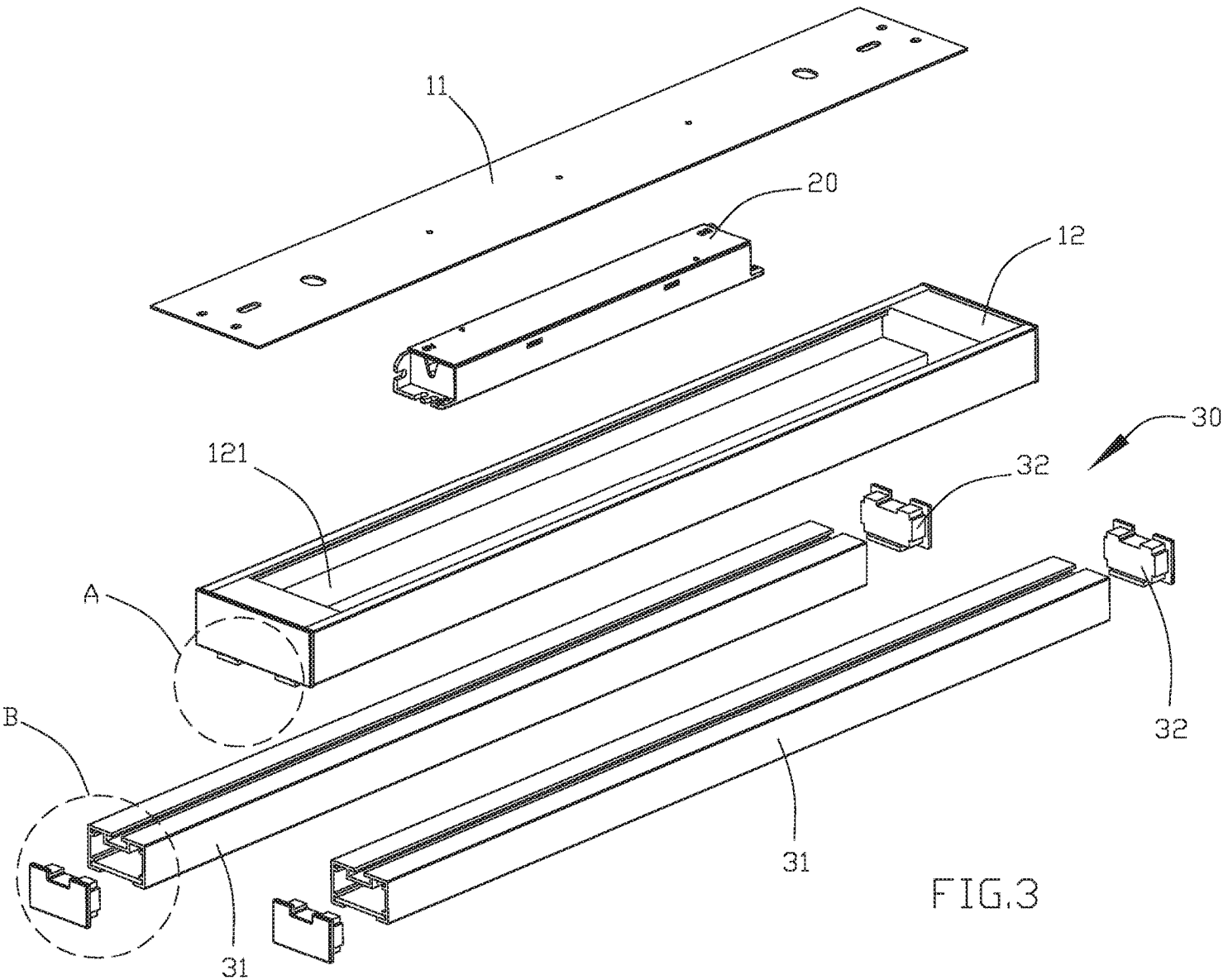
FIG. 3 is an exploded perspective view of the extendable lamp in accordance with the preferred embodiment of the present invention.
Figure 4:
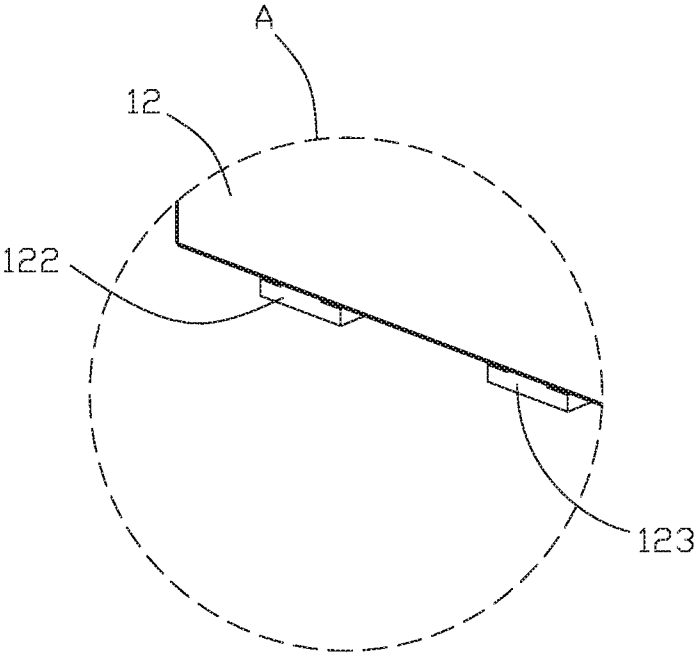
FIG. 4 is a locally enlarged view of the extendable lamp taken along mark A as shown in FIG. 3.
Figure 5:
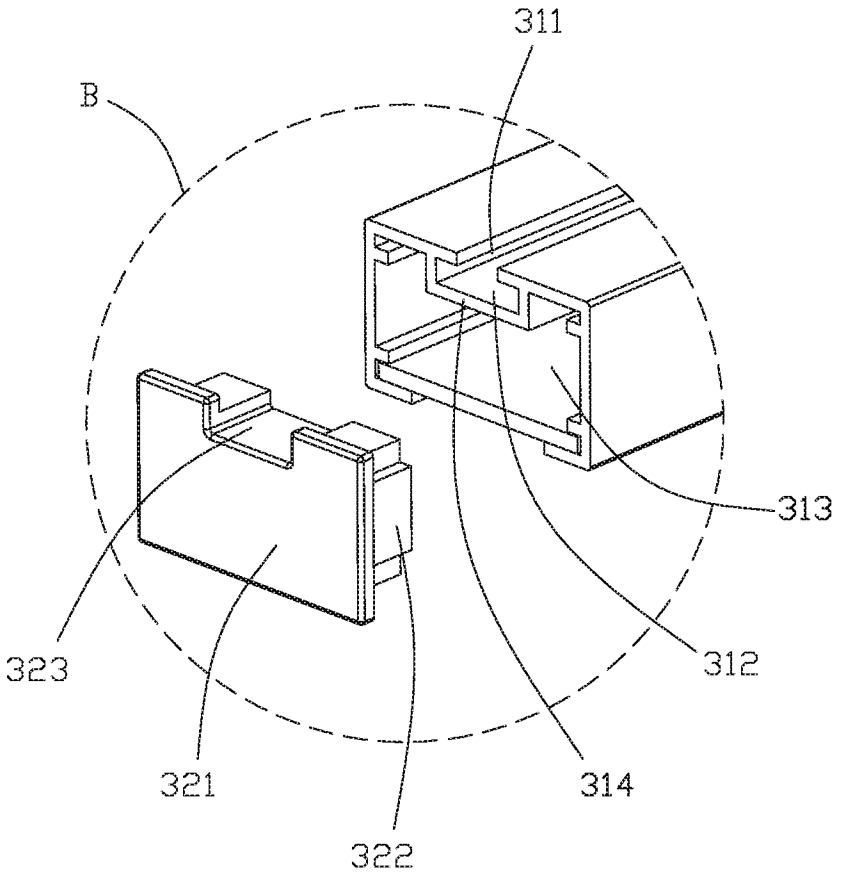
FIG. 5 is a locally enlarged view of the extendable lamp taken along mark B as shown in FIG. 3.

Accordingly, the two illuminating units 30 are moved outward from the base 10 as shown in FIG. 2, such that the length of the extendable lamp is adjusted according to the user's requirement. In addition, the two illuminating units 30 are moved to change the light emitting range, such that the user can regulate the lighting effect according to the requirement of the environment or situation.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An extendable lamp comprising:

a base having a mounting seat with an interior defining a receiving chamber, a wall plate covering the mounting seat, and two inverted T-shaped tracks provided on a surface opposite to the wall plate;

a power supply provided in the receiving chamber of the base; and two illuminating units having a housing defining a receiving slot, and two end caps mounted on two ends of the housing, the illuminating units movably coupled to the base respectively;

wherein:

each of the two tracks of the mounting seat includes a guide rail connecting and protruding from the bottom of the mounting seat, and a limit block mounted on a bottom of the guide rail; and the housing of each of the two illuminating units has a top provided with a slideway and a guide channel, such that each of the two illuminating units is slideable relative to the base by the limit block sliding along the slideway with the guide rail sliding in the guide channel.

2. The extendable lamp of claim 1, wherein each of the two illuminating units is a cuboid.

3. The extendable lamp of claim 1, wherein each of the two illuminating units has a cylindrical shape.

4. The extendable lamp of claim 1, wherein:

each of the two end caps includes a cap body and an insert mounted on the cap body;

each of the two end caps has a top provided with a mounting groove; and the mounting groove of each of the two end caps extends through the cap body and the insert.

5. The extendable lamp of claim 4, wherein:

the receiving slot of the housing has a top provided with a projection extending downward;

the mounting groove of each of the two end caps is locked on the projection of the housing; and the insert of each of the two end caps is inserted into the receiving slot of the housing.

* * * * *